US006615415B1

(12) United States Patent
Lai

(10) Patent No.: US 6,615,415 B1
(45) Date of Patent: Sep. 9, 2003

(54) TANK VALVE FOR A LAVATORY

(76) Inventor: A-Pi Lai, No. 147, Sec. 2, Min-Chuan Rd., Chung-Li City, Taoyuan Hsien (TW)

( * ) Notice: Subject to any disclaimer, the term of this patent is extended or adjusted under 35 U.S.C. 154(b) by 0 days.

(21) Appl. No.: 10/212,078

(22) Filed: Aug. 6, 2002

(51) Int. Cl.[7] ..... E03D 1/35
(52) U.S. Cl. ..... 4/392; 4/402; 4/403
(58) Field of Search ..... 4/392, 393, 402, 4/403, 404

(56) References Cited

U.S. PATENT DOCUMENTS 996,186 A * 6/1911 Willetts ..... 4/403
1,712,605 A * 5/1929 Delany ..... 4/403
2,239,923 A * 4/1941 May ..... 4/404
2,319,256 A * 5/1943 O'Hare ..... 4/404
3,154,794 A * 11/1964 Antunez, Jr. ..... 4/393
4,639,951 A * 2/1987 Lamot ..... 4/392
5,117,514 A * 6/1992 Richter ..... 4/393

* cited by examiner

*Primary Examiner*—Charles E. Phillips
(74) *Attorney, Agent, or Firm*—Rabin & Berdo, P.C.

(57) ABSTRACT

A tank valve for a lavatory has a body having a plug with a hollow. A flange is formed on a top edge of the plug. A pair of arms is formed on the flange and extends outwards. An upper ring made of a metal is mounted on a top surface of the flange. A lower ring made of a metal is mounted on a bottom surface of the flange. When a user releases a handle, the valve is immediately pivoted downwards to close a water outlet. Thus, a flow-out capacity of water can be controlled by a time of holding a handle, and a lot of water can be saved.

5 Claims, 7 Drawing Sheets

TANK VALVE FOR A LAVATORY

BACKGROUND OF THE INVENTION

1. Field of the Invention

The present invention is related to a lavatory, and more particularly to a tank valve for a lavatory.

2. Description of Related Art

Referring to FIGS. 6 and 7, in a lavatory tank (40), a conventional tank valve (50) is pivotally mounted on an overflow tube (42) by a pair of arms (54). The tank valve (50) has a flange (51) formed at a top thereof, and an ear (52) is formed on the flange (51). A lift line (53) is attached in the ear (52) and connected with a lift arm (45). A hollow semi-spherical plug (55) is formed at a bottom of the tank valve (50) for plugging a water outlet (41).

The conventional valve (50) is generally made of rubber or plastic with a low density. When a user pulls up the lift line (53), the valve (50) is pivoted up about the overflow tube (42) to open the outlet (41), and water in the tank (40) flows out from the outlet (41) and flushes the bowl (not shown or numbered).

Because the plug (55) is hollow and the valve (50) has a density lower than that of water, the valve (50) floats in the water to open the outlet (41) until a surface of the water is below the valve (50). Thus, unless all of the water in the tank flows out, the valve (50) cannot be pivoted downwards to plug the outlet (41) again. If flushing the bowl does not need so much water, as in after a child's urination, however, the user cannot control an out-flow capacity of water, and thus a lot of water is wasted.

Furthermore, early in the stage of water flowing in the tank (40), the flange (51) and the plug (55) cannot tightly close the outlet (41) because of the buoyancy exerting thereon. Water may leak out from gaps between the valve (50) and the outlet (41). When water in the tank reaches a certain level, under the pressure of the water the valve (50) then can tightly close the outlet (41). After a long time of use in water, the valve (50) will be hardened and the flange (51) may be deformed, so that the outlet (41) cannot be tightly closed and water will be leaked out too.

Furthermore, the ear (51) is often destroyed after a certain amount of use, and the lift line (53) is disengaged from the valve (50). Thus, the valve (50) must be replaced.

Therefore, the invention provides an improved a tank valve to mitigate and/or obviate the aforementioned problems.

SUMMARY OF THE INVENTION

The main objective of the invention is to provide a tank valve by which a user can control an out-flow capacity of water.

Another objective of the invention is to provide a tank valve which can immediately close an outlet of the tank when the user releases a handle.

A further objective of the invention is to provide a tank valve which has a long using life.

Other objects, advantages and novel features of the invention will become more apparent from the following detailed description when taken in conjunction with the accompanying drawings.

DETAILED DESCRIPTION OF THE PREFERRED EMBODIMENT

Figure 1:
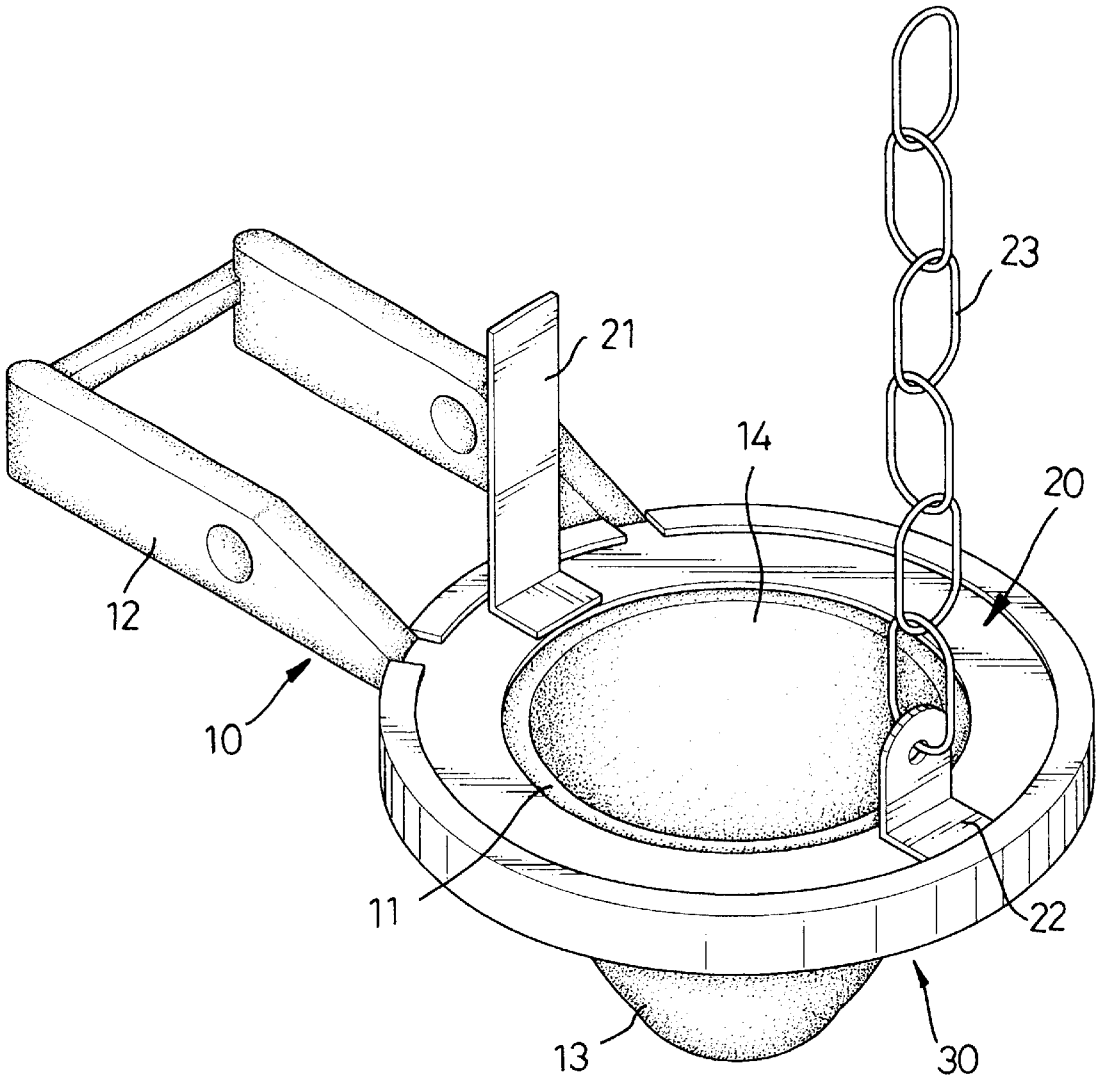
FIG. 1 is a perspective view of a tank valve in accordance with the invention.
Figure 2:
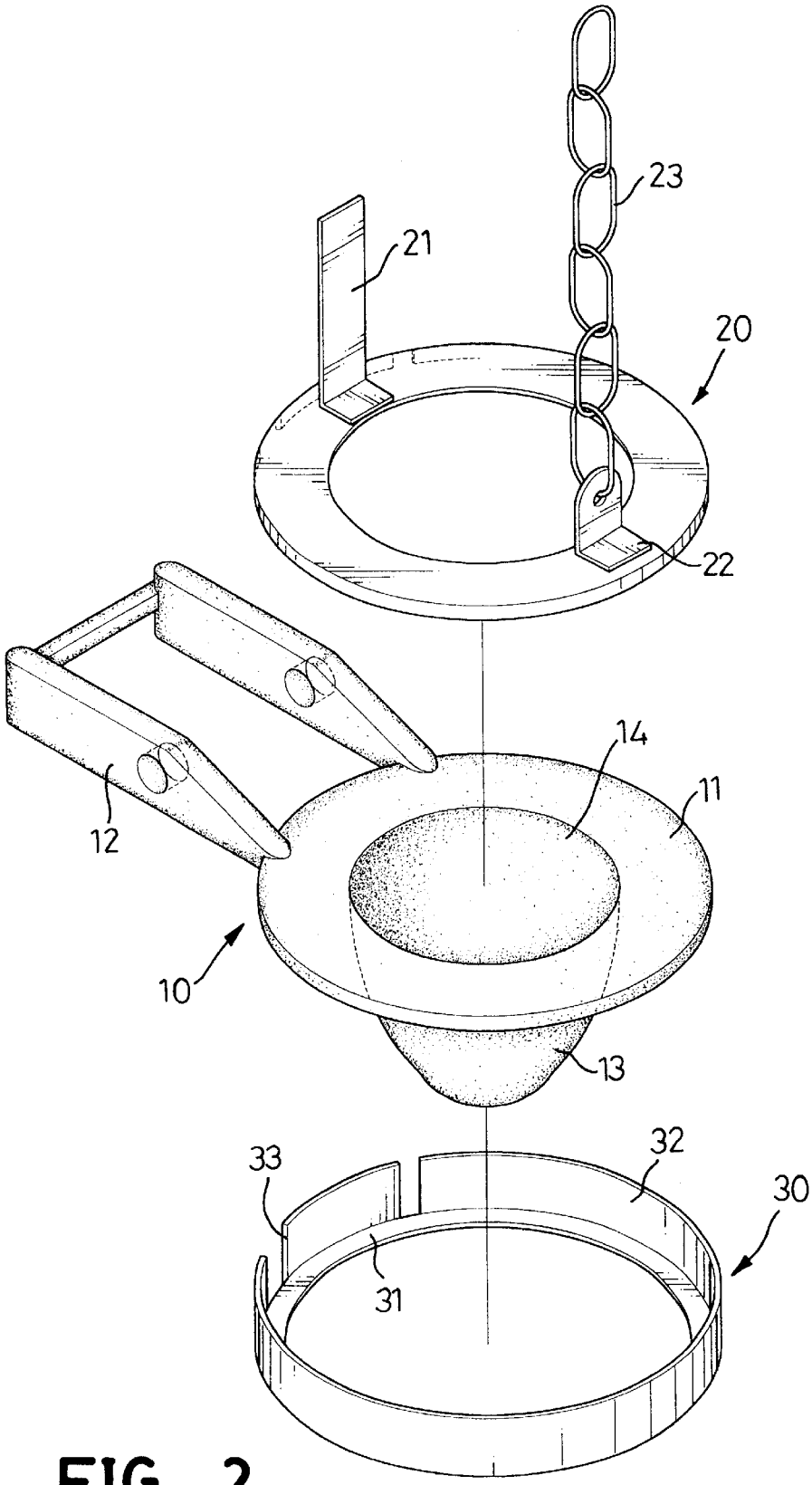
FIG. 2 is an exploded perspective view of the tank valve in accordance with the invention.
Figure 3:
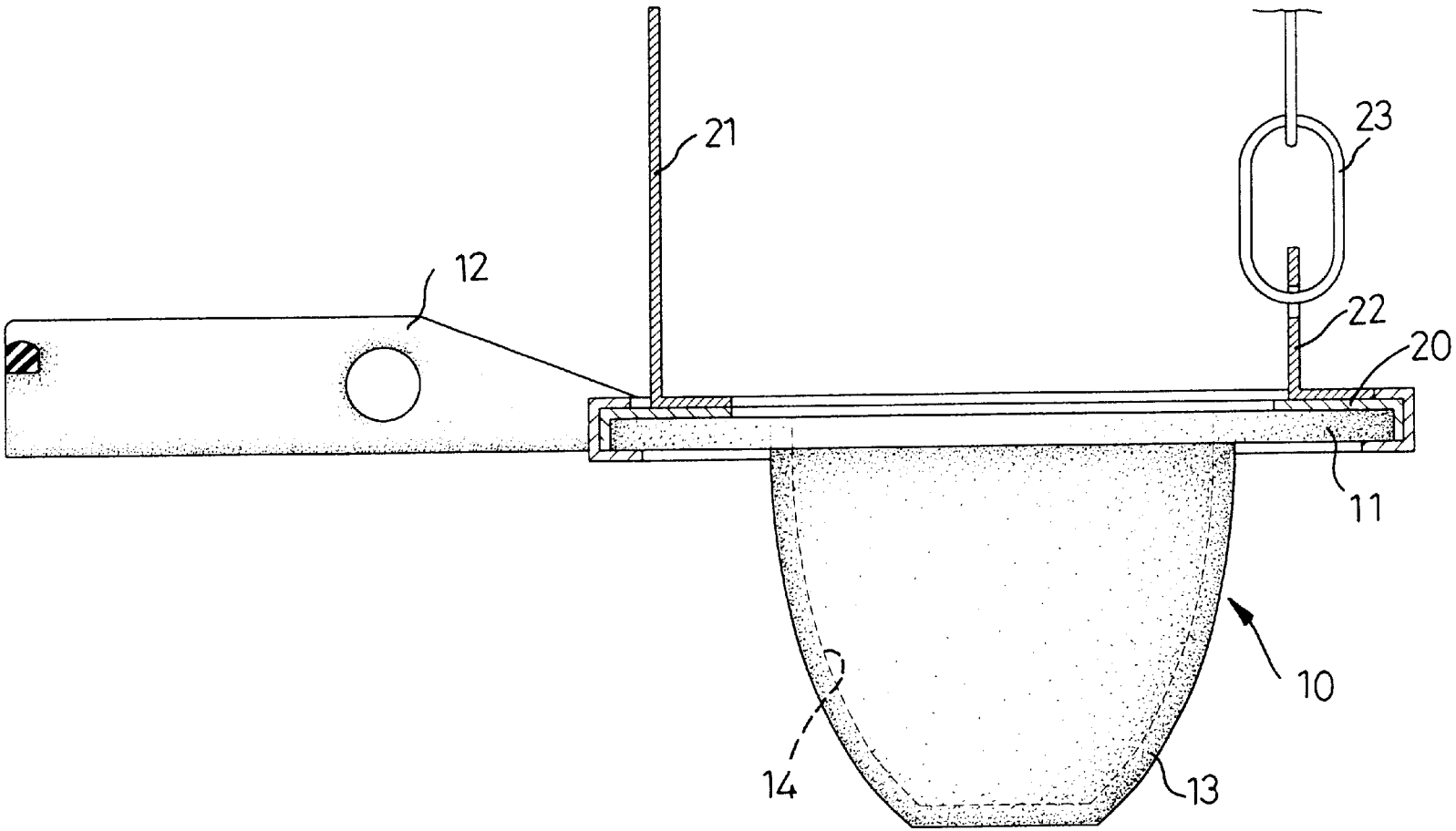
FIG. 3 is a front sectional view of the tank valve in accordance with the invention.

Referring to FIGS. 1–4, a tank valve in accordance with the invention is composed of a body (10), an upper ring (20) and a lower ring (30).

The body (10) has a semi-spherical plug (13) with a hollow (14). A flange (11) is formed on an upper edge of the plug (13), and a pair of arms (12) is formed on the flange (11) and extends outwards. By the arms (12), the tank valve is pivotally mounted on an overflow tube (42).

The upper ring (20) is made of a metal such as stainless steel and abutted a top surface of the flange (11). An L-like strip (21) is formed on the upper ring (20) and adjacent the arms (12). The upper ring (20) has an ear (22) formed at a side diametrically opposite to the arms (12). A lift line (23) is attached to the ear (22).

The lower ring (30) is also made of a metal such as stainless steel. The lower ring (30) has a side wall (32) covering an outer periphery of the flange (11). A lower rim (31) is formed at a bottom of the side wall (32) and abutted a bottom surface of the flange (11). Two notches (33) are defined at a side wall (32) of the lower ring (30). The arms (12) are respectively located in the notches (33). An upper rim (not numbered) is formed at a top of the side wall (32) and abutted the upper ring (20) on the flange (11). Therefore, the upper ring (20) is fastened on the flange (11) by the upper rim.

Figure 4:
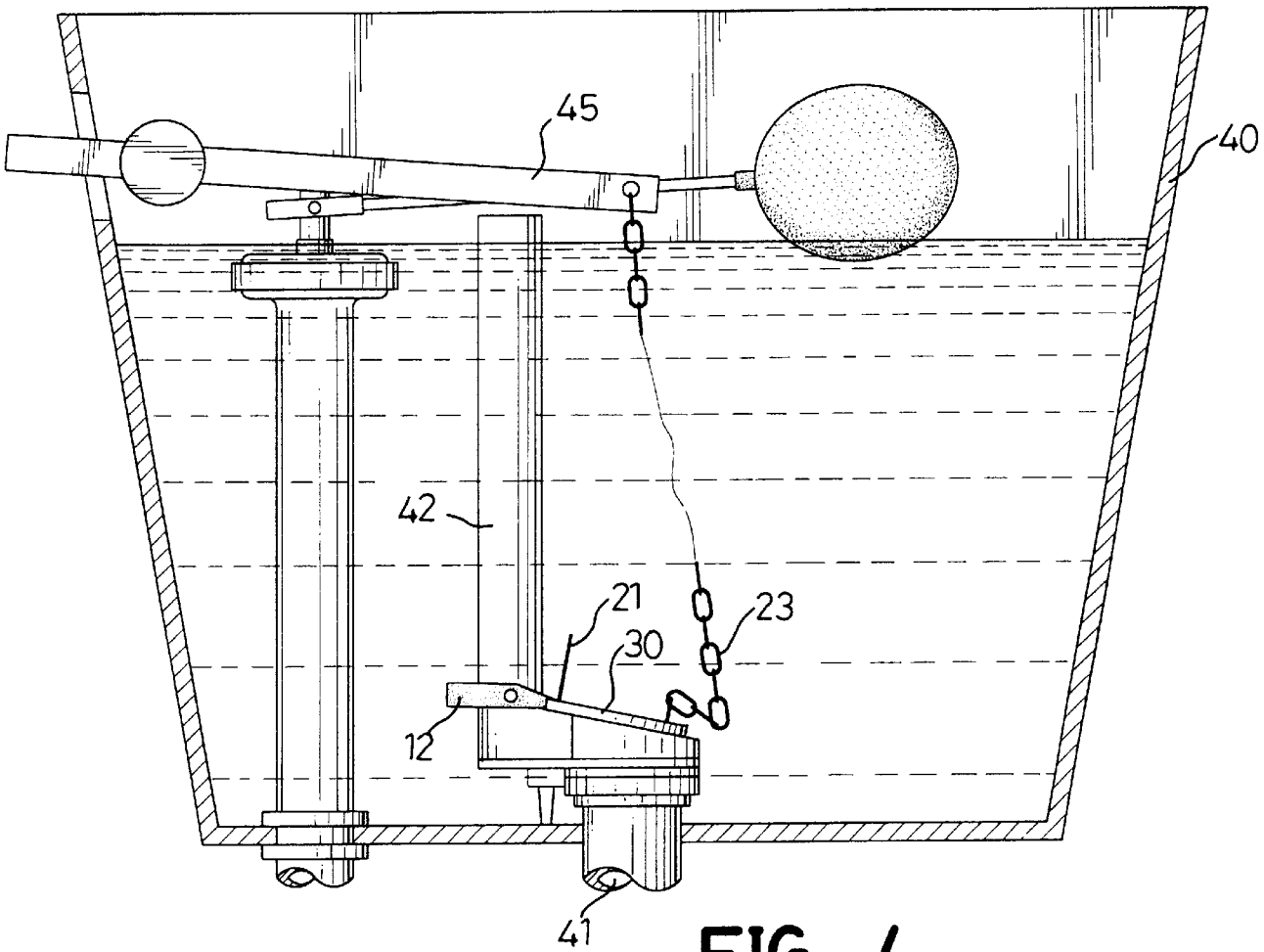
FIG. 4 is a schematic view of a tank in which the tank valve in installed.
Figure 5:
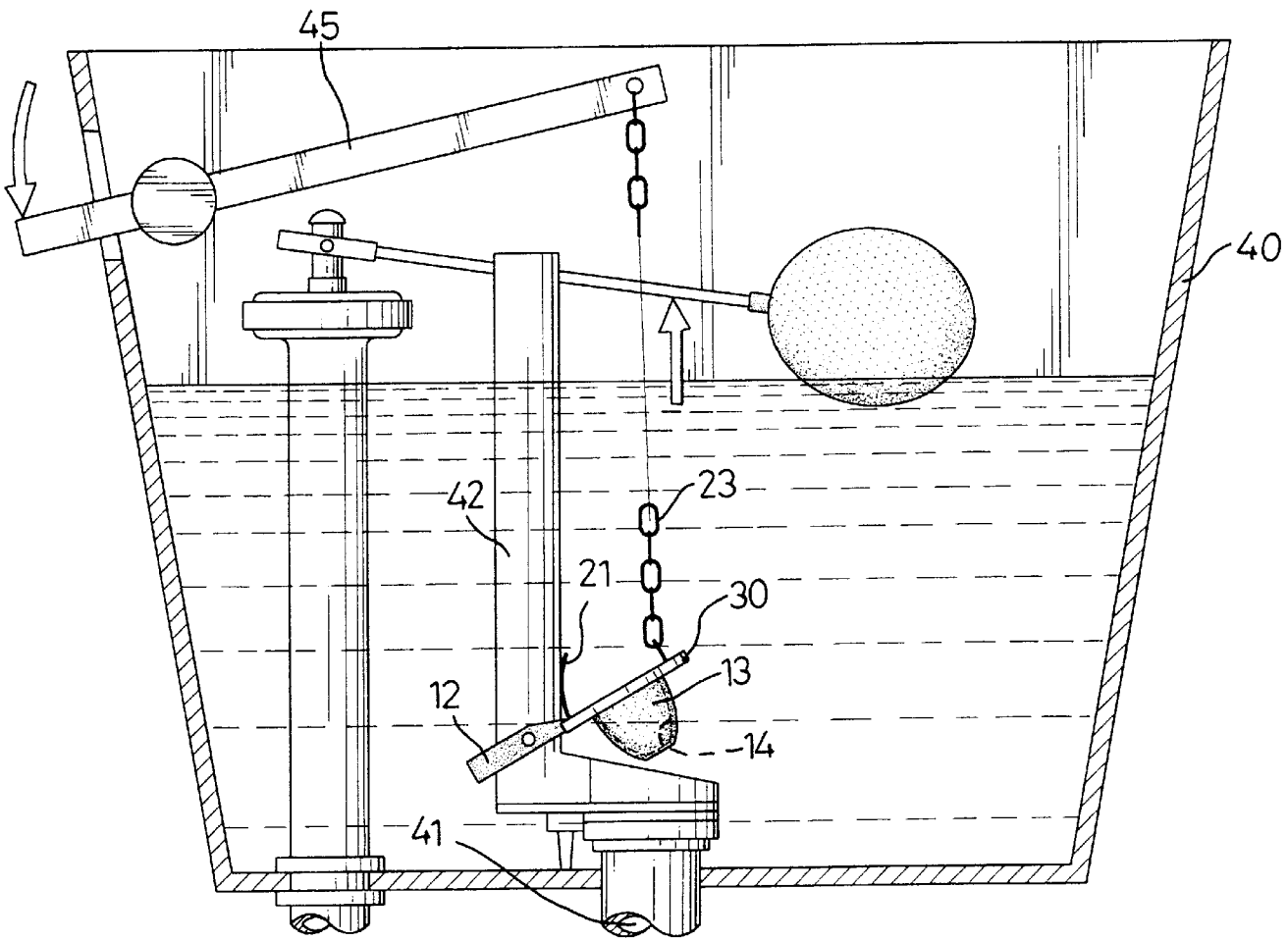
FIG. 5 is a schematic view showing that the tank valve installed in the tank is pulled up.
Figure 6:
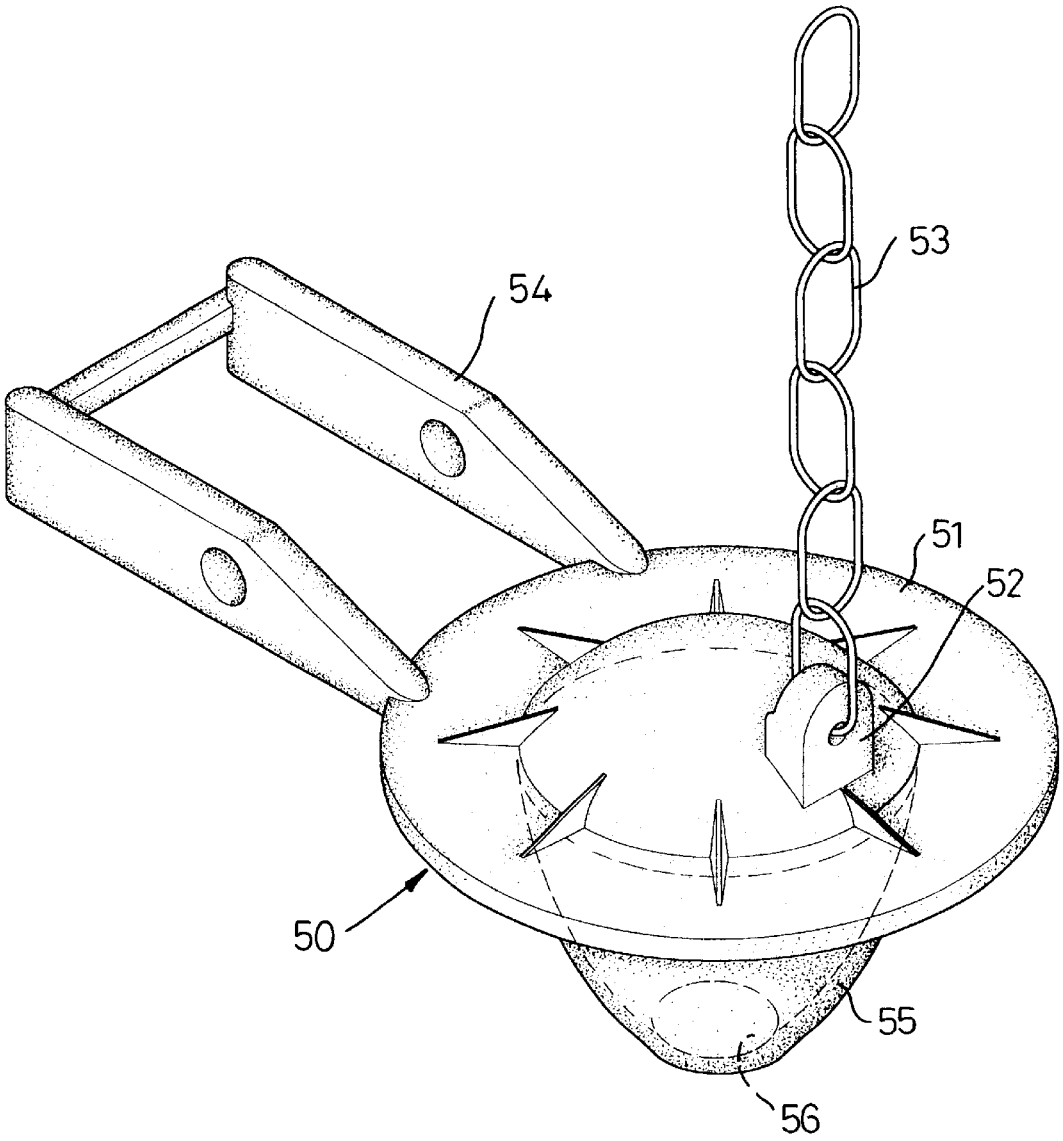
FIG. 6 PRIOR ART
FIG. 6 is a perspective view of a conventional tank valve.
Figure 7:
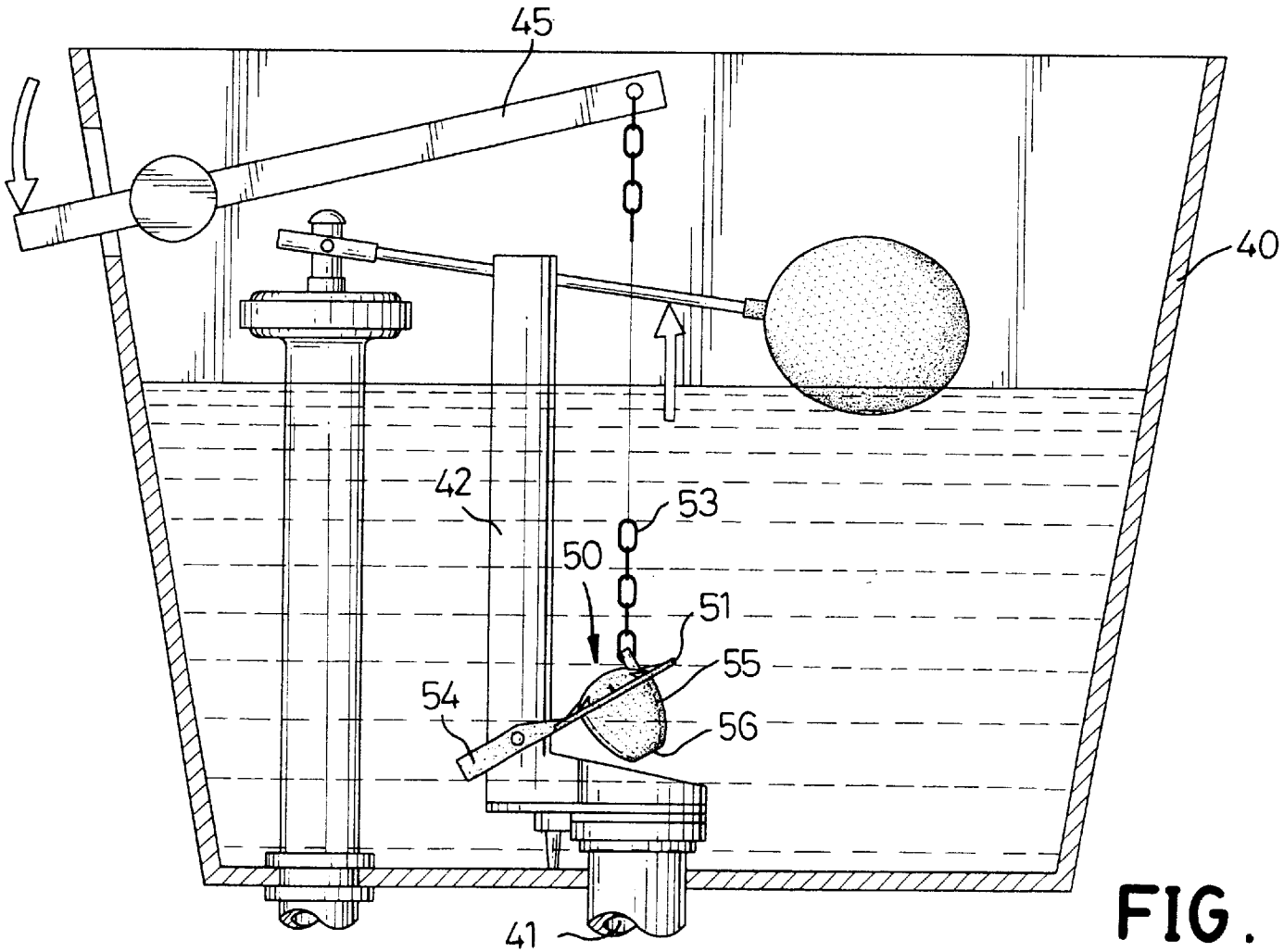
FIG. 7 PRIOR ART
FIG. 7 is a schematic view of a tank in which the conventional tank valve is installed.

Referring to FIGS. 4 and 5, the tank valve is installed in a tank (40). The tank (40) has an outlet (41) defined at a bottom thereof. The overflow tube (42) is provided beside the outlet (41). The valve is pivotally mounted on the overflow tube (42) by the arms (12), and the plug (13) is received in the outlet. Therefore, the outlet (41) is closed by the flange (11). The lift line (23) is connected with a lift arm (45) which is controlled by a handle (not shown or numbered).

When a user turns lift the arm (45) by the handle, the valve is pivoted upwards to open the outlet (41). The strip (21) is abutted the overflow tube (42) and deformed. Water in tank then flows out from the outlet (41). When the user releases the lift arm (45), under the gravity of the upper ring (20) and the lower ring (30) and a resilient force of the strip (21), the valve is immediately pivoted downwards to close the outlet (41). Thus, an out-flow capacity of water in the tank (40) can be controlled by a time of holding the handle by the user. By this means, a lot of water can be saved.

From the above description, it is noted that the invention has the following advantages:

1. An out-flow capacity of water in the tank (40) can be controlled by a time of holding the handle by a user, so that a lot of water can be saved.

2. Because the rings (20, 30) have high densities and the valve can not float in water, the flange (11) always tightly closes the outlet (41) when the handle is not held, and water in the tank (40) will not leak out.

3. The ear (22) made of a metal has a good strength and will not be destroyed over long term use.

4. The body (10) covered with the metal rings (20, 30) has a long using life.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tank valve for a lavatory comprising:

a body (10) having a plug (13) with a hollow (14), a flange (11) formed on a top edge of the plug (13), and a pair of arms (12) formed on the flange (11) and extending outwards;

an upper ring (20) mounted on a top surface of the flange (11) and made of a metal; and a lower ring (30) mounted on a bottom surface of the flange (11) and made of a metal.

2. The tank valve as claimed in claim 1, wherein the upper ring (20) has a strip (21) uprightly formed thereon and adjacent the arms (12).

3. The tank valve as claimed in claim 1, wherein the upper ring (20) has an ear (22) formed at a side diametrically opposite to the arms (12), and a lift line (23) attached in the ear (22).

4. The tank valve as claimed in claim 1, wherein the lower ring (30) has a side wall (32) abutting an outer periphery of the flange (11), a lower rim (31) formed at a bottom of the side wall (32) and abutting the bottom surface of the flange (11), an upper rim formed at a top of the side wall (32) and abutting the upper ring (20).

5. The tank valve as claimed in claim 4, wherein the lower ring (30) further has two notches (33) defined at the side wall (32) and the arms (12) are respectively located in the notches (33).

* * * * *